United States Patent [19]

Dragone

[11] Patent Number: 4,484,197

[45] Date of Patent: Nov. 20, 1984

[54] MULTIBEAM ANTENNA ARRANGEMENT WITH MINIMAL ASTIGNATISM AND COMA

[75] Inventor: Corrado Dragone, Little Silver, N.J.

[73] Assignee: AT&T Bell Laboratories, Murray Hill, N.J.

[21] Appl. No.: 352,389

[22] Filed: Feb. 25, 1982

[51] Int. Cl.[3] ..... H01Q 19/19

[52] U.S. Cl. ..... 343/781 P; 343/914; 343/779

[58] Field of Search ..... 343/779, 781 R, 781 D, 343/781 CA, 837, 840, 914

[56] References Cited

U.S. PATENT DOCUMENTS

| | | | |
|---|---|---|---|
| 4,145,695 | 3/1979 | Gans | 343/779 |
| 4,166,276 | 8/1979 | Dragone | 343/781 |
| 4,224,626 | 9/1980 | Sternberg | 343/911 |

OTHER PUBLICATIONS

Panicali et al., A reflector Antenna Corrected for . . . Aberrations, Proc. of IEEE, vol. 59, No. 2, Feb. 1971, pp. 311–312.

Wong et al., Astigmatic Correction by a Deformable Subreflector, AP-S Int. Symp. vol. II, Seattle, Wash. 1979, pp. 706–709.

*Primary Examiner*—Eli Lieberman

*Attorney, Agent, or Firm*—Erwin W. Pfeifle

[57] ABSTRACT

The present invention relates to a multibeam antenna arrangement having minimal primary aberration of astigmatism and coma over a wide area of the focal surface of the antenna. The present antenna comprises a plurality of N reflectors arranged confocally in a sequence along a feed axis of the antenna and at least one feed disposed in the vicinity of a focal point on the focal surface. The reflectors and the at least one feed are further arranged to provide an equivalent centered antenna arrangement with the longitudinal axis of the feed substantially parallel to an equivalent axis of the centered arrangement for eliminating astigmatism. Primary coma is then eliminated by deforming two of the N reflectors in a predetermined manner.

2 Claims, 6 Drawing Figures

MULTIBEAM ANTENNA ARRANGEMENT WITH MINIMAL ASTIGNATISM AND COMA

BACKGROUND OF THE INVENTION

1. Field of the Invention

The present invention relates to aplanatic reflector arrangements for offset multibeam ground station or satellite antennas and, more particularly, to multibeam antenna arrangements comprising N reflectors disposed in a particular sequential arrangement with two of the reflectors being slightly deformed in a predetermined manner to cause substantial elimination of the aberrations of primary astigmatism and coma over a wide area of the focal surface of the antenna.

2. Description of the Prior Art

Of considerable interest in practice is the problem of modifying an existing or a new antenna design so as to reduce or substantially eliminate aberrations which might be produced. More particularly, Cassegrainian and Gregorian reflector arrangements are needed for multibeam ground station and satellite antennas. In these antennas, an arrangement of two reflectors, a paraboloid and either a hyperboloid or an ellipsoid, is combined with several feeds disposed in the vicinity of a focal point. Each feed produces a beam whose direction is determined by the feed displacement from the focal point. This displacement has been found to normally cause aberrations due primarily to astigmatism and coma. Various arrangements have been derived to correct one or more of such aberrations in antennas. One such arrangement was disclosed in the article "A Reflector Antenna Corrected for Spherical, Coma and Chromatic Aberrations" by A. R. Panicali et al in Proceedings of the IEEE, Vol. 59, No. 1, February, 1971, at pp. 311–312 where a corrugated reflector with varying depths of corrugations was suggested.

In the article "Astigmatic Correction by a Deformable Subreflector" by W-Y Wong et al in AP-S International Symposium, Vol. II, Seattle, Wash., 1979, at pp. 706–709, a mechanically deformable subreflector is suggested for providing a first order astigmatic correction. Other astigmatic correction arrangements have been disclosed in, for example, U.S. Pat. Nos. 4,145,695 issued to M. J. Gans on Mar. 20, 1979 and 4,224,626 issued to R. L. Sternberg on Sept. 23, 1980. The Gans patent provides an astigmatic launcher reflector for each off-axis feedhorn which has a reflector having a curvature and orientation of its two orthogonal principal planes of curvature which are chosen in accordance with specific relationships. The Sternberg patent uses a lens having an elliptical periphery and surfaces defined by a system of nonlinear partial differential equations.

U.S. Pat. No. 4,166,276 issued to C. Dragone on Aug. 28, 1979 relates to an offset antenna having improved symmetry in the radiation pattern and comprising a curved focusing main reflector, at least one conic subreflector and a feedhorn, the combination of these elements being oriented such that the feedhorn is disposed at the focal point of the combined confocal reflectors and in a manner to coincide with the equivalent axis of the antenna system. Such arrangement allegedly eliminates astigmatism to a first order approximation.

More recently, U.S. patent application Ser. No. 209,943 filed on Nov. 24, 1980 for T. Chu, now U.S. Pat. No. 4,339,757, and U.S. patent application Ser. No. 209,944 filed on Nov. 24, 1980 for E. A. Ohm, now U.S. Pat. No. 3,343,004, each disclose different astigmatic correction means comprising a first and a second doubly curved subreflector which are curved in orthogonal planes to permit the launching of an astigmatic beam of constant size and shape over a broadband range.

The foregoing astigmatic correction arrangements, however, are primarily designed to provide such correction only for certain particular feed locations. The problem remaining in the prior art is to provide an antenna arrangement for multibeam transmission which will correct for primary astigmatism and also primary coma over a wide area of the focal surface of the antenna arrangement.

SUMMARY OF THE INVENTION

The foregoing problem has been solved in accordance with the present invention which relates to aplanatic reflector arrangements for offset multibeam ground station or satellite antennas and, more particularly, to multibeam antenna arrangements comprising N reflectors disposed in a predetermined manner to cause substantial elimination of the primary aberrations of astigmatism and coma over a wide area of the focal surface of the antenna.

It is an aspect of the present invention to provide an offset antenna with primary astigmatism and primary coma free operation in the general area of a focal point and at substantially reduced values beyond such area by confocally arranging a plurality of N reflectors in sequence to provide an equivalent essentially centered antenna arrangement which is free of primary astigmatism, and doubly curving two of the reflectors in a predetermined manner to also eliminate primary coma.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

In accordance with the present invention, a multibeam antenna arrangement is provided which eliminates the primary aberrations of astigmatism and primary coma. In the present arrangement, primary astigmatism is eliminated for feeds in the vicinity of a focal point by centering the antenna aperture with respect to an equivalent paraboloid axis. Having achieved an effectively centered arrangement, primary coma is then eliminated by doubly curving two of the reflecting surfaces of the antenna arrangement in a predetermined manner as will be explained hereinafter. Primary astigmatism and primary coma are the aberrations that arise in the vicinity of the focus of the reflector arrangement.

A preferred technique for achieving an effectively centered antenna arrangement in an offset antenna is described in U.S. Pat. No. 4,166,276 issued to C. Dragone on Aug. 28, 1979 and briefly discussed hereinbefore. In accordance with the patented arrangement, perfect performance in cross-polarization discrimination and elimination of astigmatism to a first order approximation is achieved in an antenna system by disposing a symmetrical feedhorn at the focal point of the antenna system such that the longitudinal axis of the feedhorn coincides with the equivalent axis of the antenna system. The description which follows is intended to provide the necessary background and explanation for the various arrangements of antenna elements to achieve a centered arrangement with primary astigmatism free operation in the far field of the antenna and is a condensed explanation of the patented Dragone arrangement.

Figure 1:
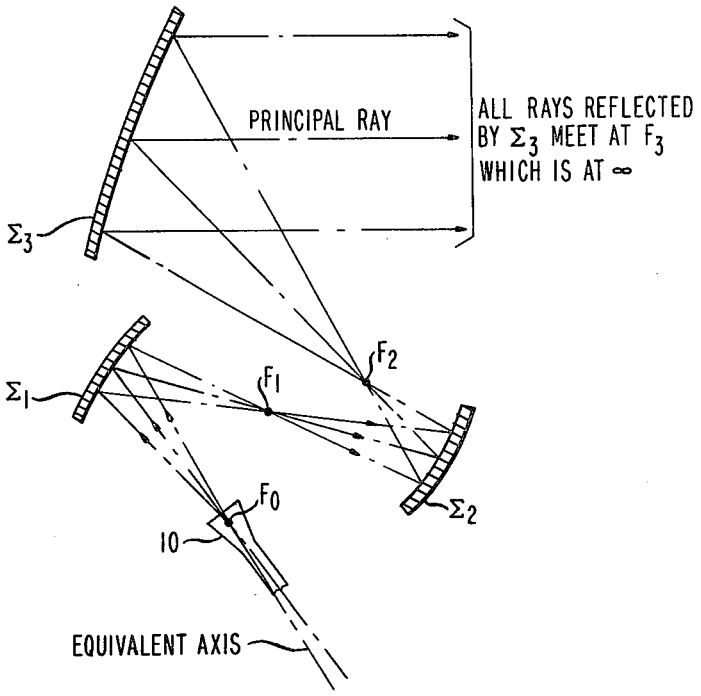
FIG. 1 (PRIOR ART)
FIG. 1 is a typical prior art antenna system where a spherical wave from a focal point $F_0$ is transformed into a plane wave by three confocal reflectors.

In FIG. 1 a typical antenna system is shown comprising a feedhorn 10 disposed at a focal point $F_0$ of the antenna system and three reflectors designated $\Sigma_1$ to $\Sigma_3$ to produce a spherical wave after each reflection which passes through focal points $F_1$ to $F_3$, respectively. Thus, in general, if $F_N$ is the focal point after the $N^{th}$ reflection, the $N^{th}$ reflector $\Sigma_N$ transforms a spherical wave centered at the focal point $F_{N-1}$, into a spherical wave centered at focal point $F_N$. It is to be understood that any of the focal points $F_0$ to $F_N$ may be at $\infty$, in which case the corresponding spherical waves become plane waves. This condition is shown in FIG. 1 by placing $F_3$ at $\infty$ which requires reflector $\Sigma_3$ to be a paraboloid.

It can be demonstrated that a sequence of confocal reflectors as shown, for example, in FIG. 1 always has an equivalent single reflector which will be either an ellipsoid, hyperboloid or paraboloid. This equivalent reflector produces, after a single reflection the same reflected wave pattern as was produced by the given sequence of reflectors. This means that the field distribution over a wavefront reflected by the equivalent single reflector will coincide with the field distribution over the corresponding wavefront produced by the given sequence of reflectors. It is to be understood that such equivalent single reflector does not of necessity coincide with the location of any one of the given sequence of reflectors or that the direction of the wavefront produced by the single equivalent reflector has to correspond to the direction of the wavefront produced by the given sequence of reflectors. The only correlation between the single equivalent reflector and the given sequence of reflectors is that the field distribution over the wavefront produced by each of the arrangements are the same.

In accordance with the foregoing explanations, for purposes of determining the properties of the reflected wave, it is possible to replace the N confocal reflectors of FIG. 1 with an equivalent reflector (not shown). The equivalent reflector has an axis of revolution which passes through focal point $F_0$ and will hereinafter be referred to as the "equivalent axis". The equivalent axis for the three reflectors of FIG. 1 may, for example, be in the direction shown in FIG. 1. How the equivalent axis is determined will be more clearly shown hereinafter. It is to be understood that in order for the symmetry of the incident beam to be preserved, the principal ray must coincide with the equivalent axis, where the principal ray is that ray which corresponds to the longitudinal axis of the feedhorn disposed at focal point $F_0$. Since, in theory, it is possible to travel along the equivalent axis in two opposite directions, two opposite orientations can be chosen for the principal ray. Suffice it to say, that for symmetry to be preserved, and in turn to eliminate cross-polarization components in the wavefront reflected by reflector $\Sigma_3$ in FIG. 1, feedhorn 10 should be reoriented to have its longitudinal axis coincide with the equivalent axis.

Figure 2:
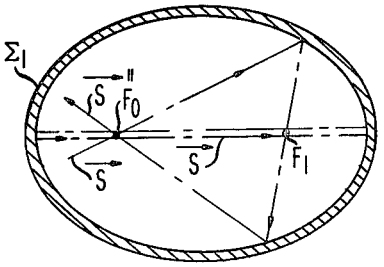
FIG. 2 (PRIOR ART)
FIG. 2 is a diagram of a method of determining the equivalent axis of a reflector via a reflected ray emanating from a foci of the reflector.

For a clear understanding of the definition and derivation of the equivalent axis, the single reflector $\Sigma_1$ as shown in FIG. 2 will be considered. If the reflector $\Sigma_1$ and one of its foci, $F_0$ are known, but the exact location of the axis of $\Sigma_1$ is not known and must be found, then the following procedure may be used. A ray emanating from foci $F_0$ is reflected twice by $\Sigma_1$ as shown in FIG. 2 where the construction of the complete reflector $\Sigma_1$ is also shown. Where s and s'' are the initial and final direction of the ray, respectively, after two reflections by $\Sigma_1$, then it can be seen that s will only equal s'' when the ray coincides with the axis of the reflector. Therefore, by searching for a ray which satisfies this condition, the axis of the reflector can be found. As can also be seen from FIG. 2, two such rays can satisfy the condition where s=s'', the one shown in the Figure and the one which emanates from $F_0$ in a direction opposite to that shown in FIG. 2 for the axial ray.

Figure 3:
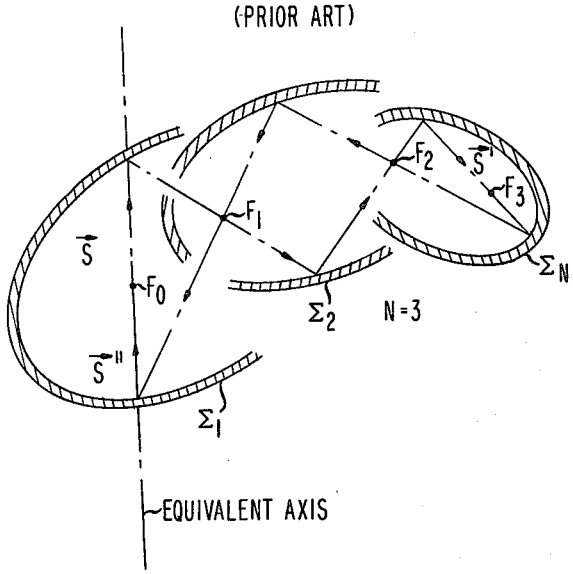
FIG. 3 (PRIOR ART)
FIG. 3 illustrates the method of FIG. 2 extended to determine the equivalent axis of a confocal sequence of N reflectors.
Figure 4:
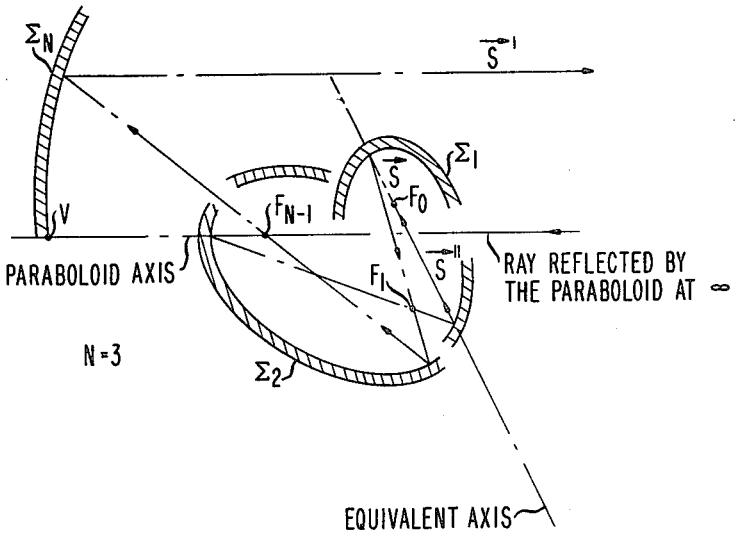
FIG. 4 (PRIOR ART)
FIG. 4 illustrates a single method for determining the equivalent axis of a sequence of N confocal reflectors where the last reflector, $\Sigma_N$, is a paraboloid in FIG. 3.

The previous description can also be extended to determine the equivalent axis for a confocal sequence of reflectors $\Sigma_1$ to $\Sigma_N$ as shown in FIGS. 3 and 4 where N=3. This is possible since, as was stated previously, a confocal sequence of reflectors has an equivalent single reflector. Thus, to determine the equivalent axis of a confocal sequence of reflectors, a ray from focal point $F_0$ with a direction s must be reflected twice by each of the reflectors $\Sigma_1$ to $\Sigma_N$ such that s=s''. The two reflections at each reflector indicates a total of 2N reflections in the original configuration and the first N reflections occur in the order $\Sigma_1, \ldots, \Sigma_N$ while, the last N reflections have the reverse order. The final ray has a direction s'' which is the same direction s as the original ray when the original ray was launched coincident with the equivalent axis of the confocal sequence of reflectors.

As shown in FIG. 3 s=s'' and, therefore, the ray through focal point $F_0$ gives the correct orientation of the equivalent axis and, in turn, the direction of the principal ray for which symmetry is preserved. More particularly, the path of the ray in FIG. 3 is closed after 2N reflections and will retrace the original path during each subsequent 2N reflections. This closed path, which determines the equivalent axis, will hereinafter be referred to as the "central path" and the two rays which proceed along the central path in opposite senses will be referred to as "central rays".

The condition that s=s'' leads to a straightforward geometrical procedure for determining the equivalent axis when the $\Sigma_N$ reflector is a paraboloid as shown in FIG. 4. In FIG. 4 it is shown that when the last reflector $\Sigma_N$ is replaced by a concave paraboloid reflector in, for example, FIG. 3, the final ray direction after two reflections therefrom becomes independent of the initial direction towards the first reflection therefrom. Therefore, the final ray after the second reflection coincides with the paraboloid axis and has a direction going from focus $F_{N-1}$ towards the vertex V of the paraboloid $\Sigma_N$.

Having substantially eliminated primary astigmastism with an equivalent centered antenna reflector arrangement, any phase error produced over the antenna aperture by a feed placed in the vicinity of focal point $F_0$ is a function of the aperture coordinate x,y and is due to primary coma aberration. In accordance with the present invention, primary coma is substantially eliminated by slightly deforming two of the antenna reflectors. For the special case of a two reflector Cassegrainian or Gregorian antenna, both reflectors can be modified. Alternatively, the subreflector can be replaced with two deformed reflectors without modifying the main reflector, or the two reflector antennas can be combined with two additional deformed reflectors. Additionally, it is to be understood that two sequential reflectors need not be deformed, although permissible, but that any two of the N reflectors are deformed as outlined hereinafter no matter where in the sequence along the feed axis.

Figure 5:
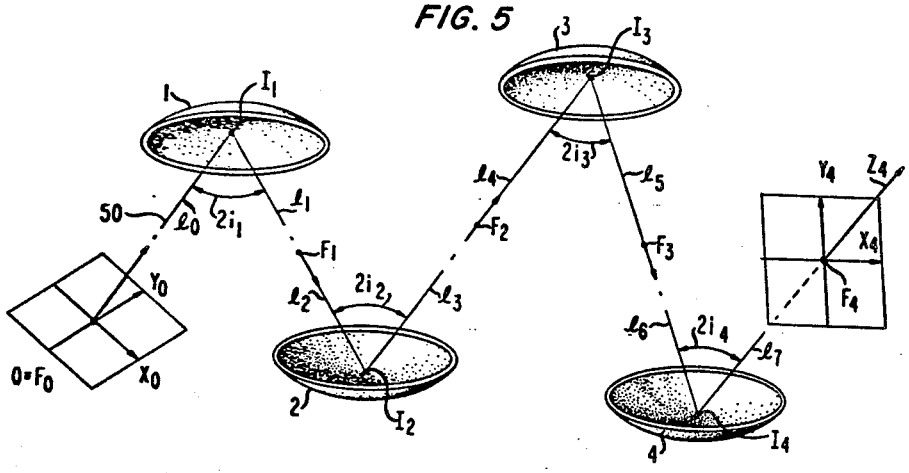
FIG. 5 is an exemplary illustrative antenna reflector arrangement including four ellipsoid reflectors for transforming an input ray into an output ray in accordance with the present invention.

For a clear understanding of the necessary deformations of two of a sequence of N reflectors to overcome primary coma once a centered arrangement is achieved, an exemplary sequence of four reflectors, where N=4, will now be considered to primarily define terms used hereinafter in accordance with the present invention. In FIG. 5, reflectors 1–4 are arranged confocally where reflector 1 has a first focal point $F_0$ on the focal surface where, for example, feedhorn 10 of FIG. 1 would be disposed with its axis along the equivalent axis. A principal ray 50 emanating from first focal point $F_0$ is reflected at a central point $I_1$ on reflector 1 with an angle of incidence $i_1$ and passes through second focal point $F_1$ of reflector 1. Focal point $F_1$ is also a focal point of reflector 2 and the principal ray 50 is reflected at a central point $I_2$ of reflector 2 with an angle of incidence $i_2$ and passes through a second focal point $F_2$ of reflector 2, which second focal point $F_2$ is also a first focal point of reflector 3. The principal ray is similarly reflected by reflectors 3 and 4 and passes through the second focal point $F_4$ of reflector 4 which is the $F_{N+1}$ focal point of the arrangement. The length $F_0$ to $I_1$ is designated $l_0$, the length $I_1$ to $F_1$ is designated $l_1$, the length $F_1$ to $I_2$ is designated $l_2$ and so forth with the length $I_4$ to $F_4$ being designated $l_7$.

Figure 6:
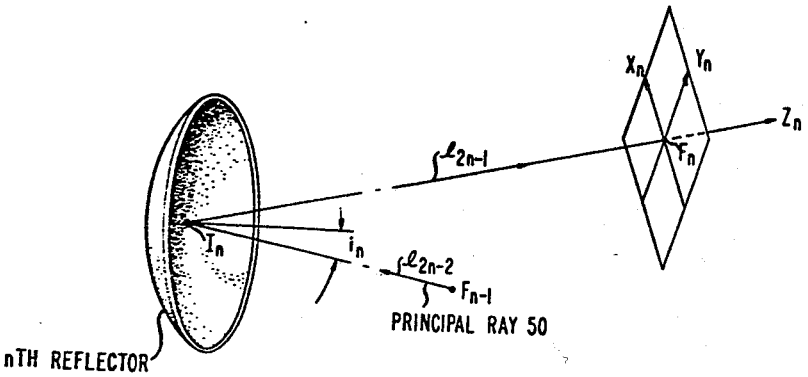
FIG. 6 illustrates any one of the ellipsoids of FIG. 5 which is to be deformed as specified in the present invention.

An optical system satisfying Abbe's sine condition, as described in greater detail in the book *Principles of Optics,* by M. Born and E. Wolf, Pemagon, N.Y., 1959 in Section 4.10 at pages 197–200, is called aplanatic and is free of primary aberrations in the vicinity of the focus. In accordance with the present invention, two of N reflectors are slightly deformed as will be described to eliminate primary coma and provide an aplanatic arrangement. To achieve such aplanatic antenna arrangement using the exemplary arrangement of FIG. 5, it is to be understood that any two of such reflectors 1–4 can be deformed. FIG. 6 is used to define the deformation necessary for any of the two reflectors.

In FIG. 6, an $n^{th}$ reflector, representing any one of the two reflectors to be deformed, is shown having a first focal point $F_{n-1}$, a second focal point $F_n$, a central point on the reflector $I_n$, an angle of incidence $i_n$ where the length $F_{n-1}$ to $I_n$ is designated $l_{2n-2}$ and the length $I_n$ to $F_n$ is designated $l_{2n-1}$. If, for example, reflector 2 of FIG. 5 were to be deformed, then n=2 and in FIG. 6, $I_n=I_2$, $F_{n-1}=F_1$, $F_n=F_2$, $l_{2n-2}=l_2$ and $l_{2n-1}=l_3$, which corresponds to the elements associated with reflector 2 in FIG. 5. It is to be understood that in FIG. 6 both lengths are positive in value since both foci are disposed in front of the $n^{th}$ reflector. However, if one of the two foci is behind the reflector, then the corresponding length is negative.

The magnification of the $n^{th}$ reflector, $M_n$, is defined by $$M_n=-(l_{2n-2}/l_{2n-1}). \tag{1}$$

For purposes of illustration, it will be assumed that the $n^{th}$ reflector is derived from an ellipsoid or hyperboloid defined by the equation $$z_n=z_n(x_n,y_n)+C_n(x_n^2+y_n^2)^2, \tag{2}$$

where $C_n$ is the coefficient of deformation of the $n^{th}$ reflector.

To determine the coefficient of deformation of a first and a second reflector of the sequence of N reflectors the designations $n_1$ and $n_2$ will be used to represent the first and second deformed reflectors, respectively, hereinafter. Primary coma free operation in an equivalent centered antenna arrangement is eliminated by deforming $n_1$ and $n_2$ in accordance with the coefficients of deformation derived from the equation:

$$-(l_{2n2-1})^4\, C_{n2}\cos^2_{i_{n2}} = (l_{2n1-1})^4 \frac{C_{n1}\cos^2_{i_{n1}}}{(M_{n1+1}\ldots M_{n2})^4} = \frac{2^5(M-1)}{(M_1\ldots M_{n2})^2 \sum_{s=0}^{n_2-n_1-1} \frac{l_{2(n1+s)}+l_{2(n1+s)-1}}{l_{2(n1+s)}\, l_{2(n1+s)-1}} (M_{n1+s+1}\ldots M_{n2})^2} \tag{3}$$

where $(M_{n1+1}\ldots M_{n2})$ represents the product of the magnifications of the reflectors $n_1+1$ to and including reflector $n_2$; M is the total magnification of the antenna arrangement; and $(M_1\ldots M_{n2})$ is the product of the magnifications of the first reflector up to and including the $n_2$ reflector of the antenna arrangement.

What is claimed is:

1. A multibeam antenna arrangement with minimal primary aberrations due to astigmatism and coma, comprising: a plurality of N sequentially confocal reflectors including N+1 separate focal points comprising at least a curved focusing offset main reflector capable of bidirectionally reflecting a beam of radiated electromagnetic energy between the $N^{th}$ and the N+1 focal points along a feed axis thereof, and a subreflector disposed along the feed axis of the main reflector comprising a curved reflecting surface capable of bidirectionally reflecting said beam between said $N^{th}$ and an N−1 focal points of N+1 separate focal points; and at least one feedhorn disposed at or in the vicinity of a first focal point of said N+1 focal points and oriented with a longitudinal axis thereof substantially parallel with an equivalent axis of the plurality of N sequential confocal reflectors, the equivalent axis being an axis of revolution which passes through the first focal point of an equivalent reflecting surface which is capable of producing after a single reflection the same field distribution over the reflected wavefront as that of the plurality of N sequential confocal reflectors characterized in that the reflecting surface of each of two of the plurality of N sequential confocal reflectors are deformed with a separate deformation coefficient, $C_n$ specifying the displacement, $Z_n$, of each point $Q_n$ of the associated reflecting surface in the $Z^{th}$ direction according to the relationship $$Z_n = C_n P_n$$

where $P_n$ is the radial distance of point $Q_n$ from the Z axis at a focal point of the reflector, and the deformation coefficient for each of the two reflecting surfaces is specified by the relationship $$-(l_{2n2-1})^4 C_{n2} \cos^2_{in2} = (l_{2n1-1})^4 \frac{C_{n1} \cos^2_{in1}}{(M_{n1+1} \ldots M_{n2})^4} = \frac{2^5(M-1)}{(M_1 \ldots M_{n2})^2 \sum_{s=0}^{n_2-n_1-1} \frac{l_{2(n1+s)} + l_{2(n1+s)-1}}{l_{2(n1+s)}\, l_{2(n1+s)-1}} (M_{n1+s+1} \ldots M_{n2})^2}$$

where the magnification of any reflector $M_n = -(l_{2n-2})/(l_{2n-1})$ with $l_{2n-1}$ and $l_{2n-2}$ being the distances along the feed axis of the antenna arrangement to a central point on the reflector from the focal point of the reflector nearest and furthest, respectively, from the first focal point of the antenna arrangement; $n_1$ and $n_2$ designate the number of the nearest and furtherest reflector, respectively, along the feed axis from the first focal point of the antenna arrangement to be deformed; i is the angle of incidence of a ray propagating between the two focal points of a reflector which impinges the central point of the reflector n; $(M_{n1+1} \ldots M_{n2})$ represents the product of the magnifications of the reflectors $n_1+1$ to and including reflector $n_2$; M is the total magnification of the antenna arrangement; and $(M_1 \ldots M_{n2})$ is the product of the magnifications of the first reflector up to and including the $n_2$ reflector of the antenna arrangement.

2. A multibeam antenna arrangement according to claim 1 wherein N=2 and each of the two reflectors is deformed in accordance with its predetermined deformation coefficient.

* * * * *